United States Patent [19]

Malone et al.

[11] 4,128,471

[45] Dec. 5, 1978

[54] COAL LIQUEFACTION PROCESS EMPLOYING CARBON MONOXIDE

[75] Inventors: Huey P. Malone; John A. Paraskos; Herman Taylor, Jr., all of Pittsburgh, Pa.

[73] Assignee: Gulf Research & Development Company, Pittsburgh, Pa.

[21] Appl. No.: 746,183

[22] Filed: Nov. 30, 1976

[51] Int. Cl.[2] ..... C10G 1/04
[52] U.S. Cl. ..... 208/8; 208/10
[58] Field of Search ..... 208/10, 8

[56] References Cited

U.S. PATENT DOCUMENTS

| | | | |
|---|---|---|---|
| 3,642,607 | 2/1972 | Seitzer | 208/10 |
| 3,692,662 | 9/1972 | Wilson et al. | 208/8 |
| 3,808,119 | 4/1974 | Bull et al. | 208/8 |
| 3,884,795 | 5/1975 | Wright et al. | 208/8 |

*Primary Examiner*—Delbert E. Gantz
*Assistant Examiner*—Joan Thierstein

[57] ABSTRACT

A process for liquefying coal employing a low temperature preheater zone, a higher temperature non-catalytic hydrocracking zone and a catalytic hydrogenation zone in series. Carbon monoxide passes through the preheater and non-catalytic hydrocracking zones but is removed from the process in advance of the catalytic hydrogenation zone.

16 Claims, 2 Drawing Figures

Figure 1:
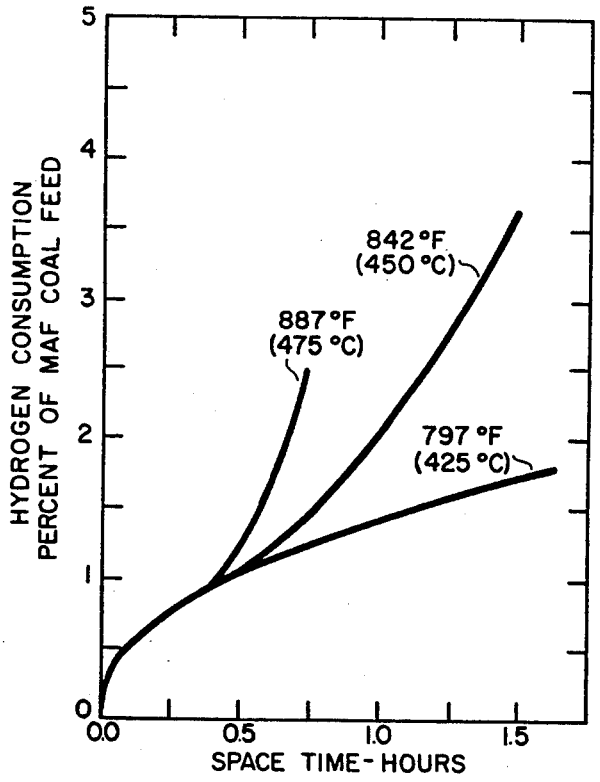

PRODUCT AND SOLVENT
FLASH
CATALYTIC REACTOR
QUENCH
HYDROGEN
CO STRIPPER
HYDROGEN
ASH
HIGH TEMPERATURE DISSOLVER
AMINE SCRUBBER
$H_2S$
CO ABSORBER
CO
$H_2$
$CO+H_2$
WET COAL SLURRY
RECYCLE FOUL WATER

COAL LIQUEFACTION PROCESS EMPLOYING CARBON MONOXIDE

This invention relates to a process employing carbon monoxide for converting ash-containing raw coal to deashed coal. More particularly, this invention relates to a process employing carbon monoxide for converting ash-containing raw coal to deashed coal liquids in preference to deashed coal solids.

The coal liquefaction process of the present invention utilizes a preheater zone, a dissolver zone and a catalyst zone in series. The preheater zone is a non-backmixed tubular zone which is supplied with a slurry of pulverized feed coal and solvent wherein the temperature of each increment or plug of slurry increases during flow through the preheater to a maximum at the preheater outlet. The preheater zone is followed by a dissolver zone operated under conditions tending to approach backmixing in order to maintain as uniform a temperature throughout as possible, which temperature is higher than the maximum temperature in the preheater zone. The dissolver zone is followed by a catalytic hydrogenation zone operated at a reduced severity as compared to the dissolver zone including a temperature which is lower than the temperature in the dissolver zone and/or a liquid residence time which is lower than the liquid residence time in the dissolver zone. The catalyst stage contains a hydrogenation catalyst comprising Group VI and Group VIII metals on alumina. Examples of suitable catalysts include cobalt-molybdenum and nickel-cobalt-molybdenum on alumina. The temperature in the dissolver zone is at least about 10° F. (5.5° C.), generally, or at least about 50° or 100° F. (27.8° or 55.5° C.), preferably, higher than the maximum preheater temperature. The temperature in the catalyst zone can be lower than the temperature in the dissolver zone. For example, the temperature in the catalyst zone can be about 25° F. (13.9° C.), or about 50° or 150° F. (27.8° or 83.3° C.), or more, lower than the dissolver temperature. Carbon monoxide is passed through both the preheater and dissolver zones, but is removed from the process in advance of the catalyst zone.

The preheater exit temperature is maintained within the range of about 710° to below 800° F. (377° to below 427° C.), generally, or 750° to 790° F. (399° to 421° C.), preferably. During the preheating step, the viscosity of each increment of feed slurry initially increases, then decreases and would finally tend to increase again. However, a significant final increase in viscosity is avoided by terminating the preheating step within the temperature range of 710° to below 800° F. (377° to below 427° C.). If the preheater temperature exceeds this range, a substantial increase in viscosity can occur caused by polymerization of the dissolved coal. Such polymerization should be avoided since its result is formation of a product comprising a relatively large quantity of low value solid deashed coal at the expense of more valuable liquid coal. These viscosity effects are described in U.S. Pat. No. 3,341,447 to Bull et al, which is hereby incorporated by reference.

A final increase in viscosity in the preheater is avoided by passing the plug flow preheater effluent which is at a temperature above about 710° but below about 800° F. (377° but below about 427° C.) into a backmixed dissolver zone maintained at a uniform temperature which is higher than the maximum preheater temperature. The dissolver temperature is within the range of about 750° to about 900° F. (399° to about 482° C.), generally, and between about 800° and 900° F. (427° and 482° C.), preferably. The temperature hiatus between the preheater and dissolver stages can be the temperature range in which undesired coal polymerization would occur. At the elevated dissolver temperature, instead of the aforementioned coal polymerization and viscosity increase, there is a viscosity decrease due to a molecular weight reduction via hydrocracking reactions. We have found that in order for the hydrocracking reactions to proceed effectively in the dissolver, a process hydrogen plus carbon monoxide pressure of at least 3,100 or, preferably, at least 3,500 psi (217 or 245 Kg/cm$^2$) is required. At lower process hydrogen pressures, the elevated dissolver temperatures of this invention in combination with the extended residence times indicated below were found to induce excessive coking and thereby encourage production of carbonaceous insolubles at the expense of coal liquids. Therefore, in the dissolver stage of this invention, the use of an elevated temperature within the range of about 750° to about 900° F. (399° to 482° C.) is accompanied by a process hydrogen plus carbon monoxide pressure between about 3,100 and 5,000 psi (217 and 350 Kg/cm$^2$), generally, and between about 3,500 and 5,000 psi (245 and 350 Kg/cm$^2$), preferably.

The residence time in the preheater zone is between about 2 and 20 minutes, generally, and is between about 3 and 10 minutes, preferably. The residence time in the dissolver zone is longer than in the preheater zone in order to provide adequate time for thermal hydrocracking reactions to occur and is between about 5 and 60 minutes, generally, or between about 10 and 45 minutes, preferably. The use of an external preheater avoids a preheating function in the dissolver zone and thereby tends to reduce the residence time in the dissolver zone, thereby reducing the amount of coking occurring in the dissolver zone. Hydrocracking and coking are concurrent reactions in the dissolver zone. Hydrocracking is the more rapid of the two reactions, and any unnecessary extension of dissolver residence time will relatively favor the slower coking reactions over the more rapid hydrocracking reactions.

The primary solvation reactions in the preheater zone occur between the solvent and the feed coal and are considered to be endothermic. In contrast, the hydrocracking reactions occuring in the dissolver zone are exothermic. Therefore, the preheater requires heat input for the solvation reactions and to heat the mass of the feed material while the dissolver not only sustains its own heat requirements but can also produce excess heat which is available for transfer to the preheater. If desired, the temperature in the dissolver can be controlled by the injection of either hot or cold hydrogen into the dissolver, or by means of a heating or cooling coil. By maintaining the indicated temperature differential between the preheater and dissolver stages the excess heat available at the dissolver is at a sufficiently elevated temperature level that it can advantageously supply at least a portion of the heat requirement of the preheater, providing a heat-balanced system.

In the absence of a subsequent catalytic stage, the dissolver effluent would be reduced in pressure and passed to a distillation zone, preferably a vacuum distillation zone, to remove overhead individual distillate fractions comprising product coal liquid, product deashed solid coal, recycle solvent and a bottoms fraction comprising ash and non-distillable hydrocarbonaceous residue. However, such a distillation step results in a considerable loss of carbonaceous material from the valuable product fractions in the form of solid deposits within the distillation column. The reason for this loss is that the dissolver effluent bottoms comprise mostly dissolved asphaltenes. The asphaltenes are not stabilized as they leave the dissolver and upon distillation some can revert to an insoluble, non-distillable material. However, such a reversion is avoided in accordance with this invention by passing the dissolver effluent at process hydrogen pressure through a catalytic hydrotreating stage.

Although the catalyst stage does not perform a coal dissolving function, it increases product yield by stabilizing asphaltenes as liquids that would otherwise separate as an insoluble solid such as coke and by partially saturating aromatics in the solvent boiling range to convert them to hydrogen donor materials for use as recycle solvent. The dissolver zone improves operation of the catalyst zone by exposing the feed stream to at least one condition which is more severe than prevails in the catalyst zone and which induces hydrocracking, thereby tending to reduce the viscosity of the flowing stream so that in the catalyst zone there is an improvement in the rate of mass transfer of hydrogen to catalyst sites in order to reduce coking at the catalyst. The more severe cracking conditions in the dissolver zone can include either or both of a longer residence time and a higher temperature than prevails in the catalyst zone. If required, the dissolver effluent can be reduced in temperature before entering the catalyst zone so that the catalyst zone is maintained at noncoking temperatures in the range of 700° to 825° F. (371° to 441° C.) and preferably in the range of 725° to 800° F. (385° to 427° C.) in order to inhibit catalyst coking and to extend catalyst life. If the catalyst zone were operated at the more severe conditions of the non-catalytic dissolver zone, the rate of mass transfer of hydrogen would be inadequate to control coke make because of the high hydrogenation-dehydrogenation reaction rates experienced in the presence of supported Group VI and Group VIII metal hydrogenation catalysts at temperatures above 700° F. (371° C.). On the other hand, temperatures in the hydrocracking range in the dissolver zone induce much less coking because in the absence of a catalyst reaction rates are sufficiently low so that the hydrogen mass transfer rate in the system is ordinarily adequate to reasonably inhibit coking at moderate residence times. While we have found that coking is controllable in a non-catalytic dissolver zone at a temperature in the range from about 750° to 900° F. (399° to 482° C.), provided that the hydrogen plus carbon monoxide pressure is within the range of this invention, we have found that without a preliminary hydrocracking zone coking is too excessive in a catalytic zone at these same temperatures and hydrogen pressures to achieve adequate catalyst aging characteristics.

We have found that the 3,100+ psi (217+ Kg/cm$^2$) pressure of this invention is critical in the catalyst zone as well as in the dissolver zone, except that in the catalyst zone this is the partial pressure of hydrogen since a hydrogenation catalyst cannot tolerate the presence of carbon monoxide. The reason for the criticality of an elevated hydrogen pressure in the catalyst zone is that, as stated above, supported Group VI and Group VIII catalysts induce high hydrogenation and dehydrogenation reaction rates. At hydrogen pressures below 3,100 psi (217 Kg/cm$^2$), dehydrogenation reactions (coking) tend to become excessive. However, at hydrogen pressures of 3,100 psi (217 Kg/cm$^2$) or more, sufficient hydrogen is dissolved in the coal liquid in the vicinity of active catalyst sites to promote hydrogenation reactions in preference to dehydrogenation reactions. The 3,100 psi (217 Kg/cm$^2$) hydrogen pressure was found to represent a threshold pressure level for inhibiting excessive dehydrogenation reactions. For example, at a hydrogen pressure of 3,000 psi (210 Kg/cm$^2$) in the catalyst stage, coking was sufficiently severe to limit the catalyst life cycle to only about 7 days. In contrast, by increasing the hydrogen pressure to 4,000 psi (280 Kg/cm$^2$), the catalyst life cycle was extended to several months. This hydrogen pressure in the catalyst zone is accompanied by a hydrogen circulation rate of 1,000 to 10,000 generally, or 2,000 to 8,000, preferably, standard cubic feet of hydrogen per barrel of oil (18 to 180 and 36 to 144 SCM/100L). The liquid space velocity in the catalyst zone can be 0.5 to 10, generally, or 2 to 6, preferably, weight units of oil per hour per weight unit of catalyst.

The encouragement of hydrogenation reactions in preference to dehydrogenation reactions in the catalyst zone further contributes to an increase of liquid product yield by providing a high yield of solvent boiling range hydrogen donor materials for recycle. Since it is hydrogen donor aromatics that accomplish solvation of feed coal, a plentiful supply of such material for recycle encourges coal solvation reactions in the preheater and dissolver zones, thereby reducing the amount of coal insolubles.

Since the catalytic production of a high yield of partially saturated aromatics is important, a measure of the effectiveness of the catalyst zone is the amount of hydrogen which is consumed in that zone. In order for sufficient hydrogenation to occur in the catalyst zone, the catalyst activity should be sufficient so that at least about 4,000 standard cubic feet of hydrogen (112 M$^3$) per ton (1,016 Kg) of raw feed coal is chemically consumed, generally, or so at least about 10,000 standard cubic feet (280 M$^3$) of hydrogen per ton (1,016 Kg) of raw feed coal is chemically consumed, preferably. At these levels of hydrogen consumption a substantial quantity of high quality hydrogen donor solvent will be produced for recycle, inducing a high yield of liquid product in the process. Such a high level of hydrogen consumption in the catalyst zone illustrates the limited capability of the non-catalytic dissolver stage for hydrogenation reactions. Furthermore, such a high level of hydrogen consumption in the catalyst zone indicates that coking deactivation of the catalyst is minimal and that the catalyst stage is not hydrogen mass transfer limited. If the system were hydrogen mass transfer limited, such as would occur if the liquid viscosity were too high or the hydrogen pressure too low, hydrogen would not reach catalyst sites at a sufficient rate to prevent dehydrogenation reactions, whereby excessive coking at catalyst sites would occur and hydrogen consumption would be low.

The above-indicated elevated levels of hydrogen consumption in the catalyst zone are possible because of the advantageous effect of the high severity dissolver zone upon the catalyst zone. In tests made without the high severity dissolver zone, the catalyst became so rapidly deactivated that these elevated levels of hydrogen consumption could be sustained for only about one week after a fresh catalyst refill, instead of several months of active catalyst life obtained with the high severity dissolver zone of this invention.

Table 1 shows the results of tests performed to illustrate the advantageous effect of elevated dissolver temperatures, even without a subsequent catalyst zone. In these tests, a slurry of pulverized Big Horn coal and anthracene oil was passed through a tubular preheater zone in series with a dissolver zone. Some vertical sections of the dissolver zone were packed with inert solids enclosed by porous partitions as shown in U.S. Pat. No. 3,957,619 to Chun et al. No external catalyst was added to the dissolver zone. Heat was added to the preheater zone but the dissolver zone was operated adiabatically. No net heat was added between the preheater and dissolver zones. Elevated dissolver temperatures were achieved by exothermic dissolver hydrocracking reactions.

The Big Horn coal had the following analysis:

| | |
|---|---|
| Feed Coal (Moisture Free) | |
| Carbon, Wt. % | 70.86 |
| Hydrogen, Wt. % | 5.26 |
| Nitrogen, Wt. % | 1.26 |
| Oxygen, Wt. % | 19.00 |
| Sulfur, Wt. % | 0.56 |
| Metals, Wt. % | 3.06 |
| Ash, Wt. % | 6.51 |
| Sulfur, Wt. % | 0.32 |
| Oxygen, Wt. % | 3.13 |
| Metals, Wt. % | 3.06 |
| Moisture, Wt. % | 21.00 |

Following are the data obtained in the tests:

TABLE 1

| | | | |
|---|---|---|---|
| Run Time (days) | 3.88 | 5.00 | 11.38 |
| MAF* Coal In Slurry, Wt. % | 29.53 | 29.53 | 29.53 |
| MAF* Coal Rate, gm/hr | 1225.71 | 1101.42 | 1035.20 |
| Preheater Outlet Temp., ° F. (° C.) | 713(378) | 715(379) | 729(387) |
| Dissolver Temp., ° F. (° C.) | 750(399) | 775(413) | 800(427) |
| Total Pressure, psi (Kg/cm$^2$) | 4100(287) | 4100(287) | 4100(287) |
| $H_2$ pp, psi (Kg/cm$^2$) | 3785(265) | 3842(269) | 3828(268) |
| Unconverted Coal, Wt. % of MAF* Coal | 32.48 | 24.67 | 12.20 |
| Chemical $H_2$ Consumption decimeters$^3$/kg MAF* Coal | 341.96 | 468.42 | 749.10 |
| Conversions, Wt. % MAF* Coal | | | |
| Solvation | 67.52 | 75.36 | 87.80 |
| Hydrocracking (fraction of MAF* coal converted to product boiling below 415° C.) | 17.31 | 31.65 | 54.33 |
| Denitrogenation, Wt. % | 4.78 | 6.31 | 21.32 |
| Oxygen Removal, Wt. % | 42.98 | 47.89 | 51.53 |

*MAF means moisture-and ash-free

The data of Table 1 show that as the dissolver temperature was increased in steps from 750° to 775° and 800° F. (399° to 413° and 427° C.), so that the temperature differential between the preheater and dissolver was increased from 37° F. to 60° F. and 71° F. (20° to 33° and 39° C.), respectively, the amount of coal dissolved increased from 67.52 to 75.36 and 87.80 weight percent of MAF coal, respectively, while the fraction of MAF coal converted to product boiling below 415° C. (779° F.) increased from 17.31 to 31.65 and 54.33 weight percent of MAF coal, respectively. These results illustrate the substantial advantage in terms of both quantity and quality of product obtained by autogenously increasing the temperature differential between the preheater and the dissolver stages by means of exothermic dissolver hydrocracking reactions. Not only is the product quantity and quality advantageously increased as the dissolver temperature and the temperature differential between the stages are increased, but also the process advantageously can become increasingly self-sufficient in heat requirements by transferring the increasingly high level sensible heat autogenously generated at the dissolver to the preheater. One means of accomplishing this heat transfer is by cooling the dissolver effluent by heat exchange with the preheater feed stream. A noteworthy feature of the tests is that the increasing temperatures were achieved in the dissolver with no net addition of heat to the process between the preheater and dissolver zones.

The present invention which employs a catalyst zone downstream from the dissolver zone is illustrated by the data of Tests 1 through 5, presented in Table 2. Tests 1 through 5 all employed a catalyst zone. Test 1 was performed with only preheater and fixed bed catalyst stages, without any filtering or other solids-removal step between the stages and without any dissolver stage. Tests 2, 3 and 4 were performed with the dissolver stage, but without a dissolver vent, using a stream comprising 95 percent hydrogen as a quench between the dissolver and fixed bed catalyst stages, but without a solids-removal step in advance of the catalyst stage. Test 5 was performed with a dissolver stage which was vented to remove a gaseous stream containing 85 to 90 percent hydrogen. In all the tests employing a dissolver the preheater temperature was below 800° F. (427° C.), specifically 720° to 790° F. (382° to 421° C.), and the solvent used was vacuum tower overhead from previous coal liquefaction runs. In the stage employing a catalyst, the catalyst was a nickel-cobalt-molybdenum on alumina hydrogenation catalyst packed in vertical zones having a porous partition communicating with alternate vertical zones free of catalyst.

TABLE 2

| | Test 1 | Test 2 | Test 3 | Test 4 | Test 5 |
|---|---|---|---|---|---|
| Preheater, ° C. (° F.) | — | 382 (720) | — | 421 (790) | 421 (790) |
| Dissolver Temp., ° C. (° F.) | No dissolver | 456 (853) | 456 (853) | 482 (900) | 483 (902) |
| Reactor (Cat.), ° C. (° F.) | 388 (730) | 388 (730) | 412 (775) | 387 (729) | 389 (730) |
| Reactor WHSV (kg MAFC*/hr/kg Cat.) | | 1.29 | 1.28 | 1.34 | 1.27 |
| Dissolver WHSV (kg A.R.C.**/hr/liter) | | 1.05 | 1.04 | 1.22 | 1.16 |
| Yields, Wt. % MAFC*: | | | | | |
| $H_2$ Consumption | −3.12 | −4.9 | −5.9 | −6.1 | −4.6 |
| $C_1 - C_5$ | 1.13 | 11.8 | 13.9 | 18.8 | 14.0 |
| $C_6$ - 200° C. | 4.14 | 18.1 | 20.7 | 22.4 | 20.0 |
| 200 - 415° C. | | 9.1 | 16.2 | 4.1 | 10.8 |
| 415° C. + (° F.+) | 59.24 | 28.5 | 22.5 | 36.0 | 39.3 |
| Unconverted Coal | 29.73 | 14.5 | 10.8 | 5.7 | 6.4 |
| $H_2S$ | 0.23 | 0.5 | 0.3 | 0.3 | .2 |
| CO, $CO_2$ | 2.34 | 10.8 | 12.2 | 5.4 | 4.8 |
| $H_2O$ | 5.95 | 11.6 | 9.3 | 13.4 | 9.1 |
| Solvation | — | 85.5 | 89.2 | 94.3 | 93.6 |
| Conversion (fraction of MAFC* converted to material boiling | | | | | |

TABLE 2-continued

| | Test 1 | Test 2 | Test 3 | Test 4 | Test 5 |
|---|---|---|---|---|---|
| below 415° C. (779° F.) | 11.03 | 57.0 | 66.7 | 58.3 | 54.3 |
| Recycle Solvent (450 – 775° F. (232 – 412° C.) vacuum tower overhead); % of process requirement | — | — | 96.8 | 92.6 | 98.9 |

*Moisture-and ash-free coal
**As received coal

The data of Test 1 of Table 2 show that without a dissolver stage 29.73 percent of the coal exclusive of moisture and ash remained undissolved and only 11.03 percent was hydrocracked to product boiling below 415° C. (779° F.). Hydrogen consumption was only 3.12 weight percent, based on MAF coal.

The data of Tests 2, 3 and 4 of Table 2 show that the use of a dissolver increased the yields of $C_1$ to $C_5$ products and gasoline, while decreasing the amount of 415° C.+ (779° F.+) oil. Undissolved coal was decreased from 29.73 percent to 14.5 percent, or less. However, these improved yields resulted in increased hydrogen consumptions. Also, the yield of heavy oil was reduced so drastically that the process did not produce its full recycle solvent requirement. Tests 2, 3 and 4 show that as the dissolver temperature increased, the amount of unconverted coal decreased but at the expense of a considerable increase in hydrogen consumption.

The data of Test 5 of Table 2 were taken with a vented dissolver and with the same dissolver stage temperature that was employed in Test 4. In both Tests 4 and 5 the rate of hydrogen flow to the preheater was 100 SCF/hr (2.8 $M^3$/hr), while in Test 5 as compared to Test 4 the rate of hydrogen flow to the dissolver was increased to between about 200 and 250 SCF/hr (5.6 and 7 $M^3$/hr) to make up for hydrogen loss due to venting. The vented dissolver reduced hydrogen consumption from 6.1 to 4.6 percent without any significant change in the amount of coal dissolved. Test 5 shows that use of a vented dissolver resulted in less light products, including $C_1$ to $C_5$ products and light gas oil, and in a higher yield of heavy oil. The higher yield of heavy oil advantageously increased recycle solvent yield from 92.6 to 98.9 percent of process requirements.

The vented gases in Test 5 comprise acidic materials, such as carbon monoxide and carbon dioxide. Acidic materials can induce hydrocracking with a hydrogenation catalyst. The reduced hydrogen consumption of Test 5 may be due to the removal of the acidic gases from the process via venting in advance of the catalyst stage. The vented stream included hydrocarbons having a 450° F. (232° C.) EP and included about 75 to 90 percent of the dissolver content of carbon monoxide and carbon dioxide as well as substantially all the water present in the feed coal. Removal of these materials and the substitution thereof with a quench stream comprising a higher concentration of hydrogen than the vented stream results in an enhanced hydrogen partial pressure in the catalyst stage.

The dissolver residence time is between about 5 and 60 minutes, providing sufficient time for solids to settle. By separately removing a supernatant liquid stream and a settled solids stream, there can be a controlled build-up of solids in the dissolver, if desired. The coal ash solids contain materials, such as FeS, which are hydrogenation catalysts and provide a beneficial effect in the process. The catalytic effect of coal ash solids in a dissolver zone is disclosed in U.S. Pat. No. 3,884,796 to Hinderliter et al, which is hereby incorporated by reference. Thereby, there can be a controlled catalytic hydrogenation effect in the dissolver zone even though no extraneous catalyst is added to the dissolver zone.

Another advantage of the venting step may arise because the low boiling hydrocarbons which are vented tend to be saturated compounds while the higher boiling non-vented hydrocarbons tend to be aromatics. Since the 1004° F.+ (541° C.+) bottoms of a coal liquid are largely asphaltenes, and since asphaltenes require a highly aromatic medium for solubilization, the selective venting of saturated compounds tends to provide an asphaltene-compatible liquid, thereby inhibiting deposition of asphaltenes in the appartus or on the catalyst in the subsequent stage. Table 3 shows the saturates, olefins, aromatics and resins content in percent in various distillate fractions of an Illinois coal liquid. Defining the terms of Table 3, resins and asphaltenes are the residue of a n-propane extraction but of this residue, resins are soluble in n-pentane while asphaltenes are insoluble.

TABLE 3

| Boiling Range of Fraction, ° C. (° F.) | | Saturates | Olefins | Aromatics | Resins |
|---|---|---|---|---|---|
| OP-174 | (OP-345) | 68.0 | 5.5 | 26.5 | — |
| 174-203 | (345-397) | 32.0 | 2.5 | 65.5 | — |
| 203-229 | (397-444) | 20.0 | 1.5 | 78.5 | — |
| 229-247 | (444-477) | 5.5 | 1.0 | 93.5 | — |
| 247-263 | (477-506) | 3.0 | 1.0 | 96.0 | — |
| 324-341 | (615-646) | 2.5 | — | 90.9 | 6.6 |
| 341-350 | (646-662) | 4.0 | — | 85.0 | 10.7 |
| 350-364 | (662-687) | 5.0 | — | 83.0 | 12.0 |
| 364-374 | (687-705) | 4.9 | — | 85.1 | 10.0 |
| 374-391 | (705-736) | 5.8 | — | 82.7 | 11.5 |
| 391-411 | (736-772) | 9.4 | — | 75.5 | 14.2 |
| 411-490 | (772-914) | 9.2 | — | 68.8 | 21.0 |
| 490-541 | (914-1006) | 2.0 | — | 63.0 | 34.8 |
| 541+ | (1006+) | | NOTE | | |

NOTE -
Bottoms Contained 0.1% Saturates + Aromatics, 0.3% Resins, 60.6% Asphaltenes, and 38.9% Benzene Insolubles Table 3 shows a high level of asphaltenes in the bottoms of the system. It is apparent from Table 3, that the removal by venting of the relatively low boiling hydrocarbons in a coal liquid provides an increasingly aromatic solution of increasing capability for stabilizing or forming a single phase with the asphaltenes in the bottoms.

When carbon monoxide is charged to the preheater in place of or together with hydrogen to react with water in the process to produce hydrogen in situ, it is important that the carbon monoxide be vented or otherwise removed substantially completely from the dissolver effluent liquid and replaced by a substantially carbon monoxide-free hydrogen stream. Carbon monoxide is known to be a poison for metallic hydrogenation catalysts. It becomes strongly adsorbed on metallic hydrogenation catalysts to destroy the activity thereof. In many catalytic hydrogenation processes for converting petroleum oils, the carbon monoxide level must be maintained less than 500 weight ppm, generally, and less than 100 weight ppm, preferably. Furthermore, even if carbon monoxide is not introduced to the process, the coal conversion process itself produces carbon monoxide by conversion of oxygen in the coal and this carbon monoxide must be vented if its levels exceed these limitations.

It is not economical to remove the carbon monoxide by low pressure flashing since the remaining hot liquid will then require a costly repressurization step prior to entering the catalytic hydrogenation chamber. However, the partial pressure of the carbon monoxide can be reduced without reducing the total pressure by passing dissolver effluent to a stripping zone and bubbling a stripping gas such as hydrogen or an inert gas such as nitrogen or carbon dioxide through it. The stripping gas employed will be at unit pressure. If hydrogen is used as a stripping gas, the used stripping gas containing carbon monoxide can be passed to a carbon monoxide-hydrogen separating zone or it can be recycled to the preheater zone. In addition to purifying the dissolver effluent liquid of carbon monoxide, the effluent liquid is concomitantly cooled in advance of the catalyst zone. Again, if hydrogen is employed as a stripping gas, the heat acquired by the used hydrogen as well as the carbon monoxide it contains are both advantageously utilized within the process when the hot hydrogen-carbon monoxide gaseous mixture is passed to the process preheater zone.

Since the present process is a high hydrogen-consuming process, it is economic to charge carbon monoxide to the process instead of hydrogen. The carbon monoxide reacts with the water present in the feed coal according to the water gas shift reaction to produce hydrogen and carbon dioxide. Since this reaction consumes water, the make of foul waste water in the process can be reduced by recycling foul water. Thereby, the process foul water disposal problem is ameliorated. Since a dissolver vent or stripper zone advantageously permits removal of carbon monoxide in advance of the catalyst stage, carbon monoxide will be prevented from deactivating the catalyst stage. Purification of the used stripper gases by scrubbing of hydrogen sulfide and carbon oxides provides a purified hydrogen stream which is available for charging to the catalyst stage. In this manner, carbon monoxide charged to the non-catalytic preheater and dissolver stages is utilized to manufacture hydrogen for the subsequent catalytic stage, even though the carbon monoxide itself is scrubbed from the stream reaching the catalyst stage.

A settled heavy sludge or coke can be removed from the bottom of the dissolver, below the dissolver liquid draw off line. This stream can comprise more than about 30 or 50 weight percent of ash-containing solids. It can be passed directly to a gasifier for conversion of its hydrocarbonaceous content to carbon monoxide and hydrogen. If desired, it can first be passed through a hydroclone for partial recovery of deashed coal liquids for recycle to the dissolver.

A further advantage can be achieved in accordance with the present invention by introducing sodium carbonate into the system, preferably in aqueous solution, in addition to the carbon monoxide. Sodium carbonate is known to catalytically assist the water gas shift reaction. In addition, it is disclosed in *Industrial and Engineering Chemistry, Process Design and Development,* Vol. 15, No. 3, 1976, that in a catalytic coal liquefaction process sodium carbonate promotes reaction of carbon monoxide with the coal in preference to reaction of hydrogen with the coal, thereby providing a product gas having an enhanced $H_2/CO$ ratio. This article states that the sodium carbonate promotes the reaction of carbon monoxide with the oxygen present in the coal to form carbon dioxide, instead of consuming hydrogen for this reaction. Such a mechanism increases the yield of hydrogen from the preheater and dissolver zones available for use in the catalyst zone.

The water gas shift reaction involves the conversion of carbon monoxide and water to carbon dioxide and hydrogen as follows: $CO+H_2O \rightleftarrows CO_2+H_2$. This reaction is exothermic and the equilibrium is unaffected by pressure. However, low temperatures favor completion of the reaction. Following are equilibrium constants Kp at various temperatures, where $kp = P_{CO_2}P_{H_2}/P_{CO}P_{H_2O}$.

| Temperature, ° F. (° C.) | Kp, Atmospheres |
|---|---|
| 500 (260) | 78.0 |
| 600 (316) | 36.0 |
| 700 (371) | 17.5 |
| 800 (427) | 9.2 |
| 900 (482) | 5.6 |
| 1,000 (538) | 3.75 |

The above data show that the production of hydrogen via the shift reaction is enhanced at relatively low temperatures. On the other hand, FIG. 1 illustrates hydrogen consumption data in a coal dissolver at various space times and shows that in a coal dissolver hydrogen is consumed most rapidly at high temperatures. The above data and FIG. 1 illustrate the particular effectiveness derived from employing in combination a relatively low temperature preheater and a relatively high temperature dissolver when producing hydrogen via the shift reaction. The data show that the equilibrium favors the formation of hydrogen at the relatively low temperature of the preheater. However, FIG. 1 shows that the hydrogen produced is most rapidly consumed (via hydrocracking reactions) at a relatively high temperature. The indicated high rate of hydrogen consumption obtained by employing a high temperature in the dissolver tends to prevent the reversal of the shift reaction, which the above data for Kp show would otherwise tend to occur at high temperatures if the hydrogen were not being consumed.

Therefore, when employing the shift reaction for in situ production of hydrogen, the relatively low temperature of the preheater zone and the relatively high temperature of the dissolver zone function interdependently. The lower temperature in the preheater zone favors the conversion of carbon monoxide and water to hydrogen while the subsequent higher temperature in the dissolver zone tends to prevent reversal of the reaction in the dissolving process by increasing the rate of consumption of the hydrogen produced via hydrocracking reactions.

The use of a dissolver vent also exerts an interdependent function in inhibiting reversal of the shift reaction. The continuous venting of dissolver gases accomplishes cooling of excess gases not required for hydrocracking reactions to temperatures more favorable to the preservation of the hydrogen product. Reversal of the shift reaction thereby tends to be prevented by physical removal of the shift reaction components. The hydrogen in the removed gases is then purified and advantageously utilized in a purified state in the catalytic reaction stage wherein more than 100–500 ppm by weight of carbon monoxide is injurious to the catalyst.

Figure 2:
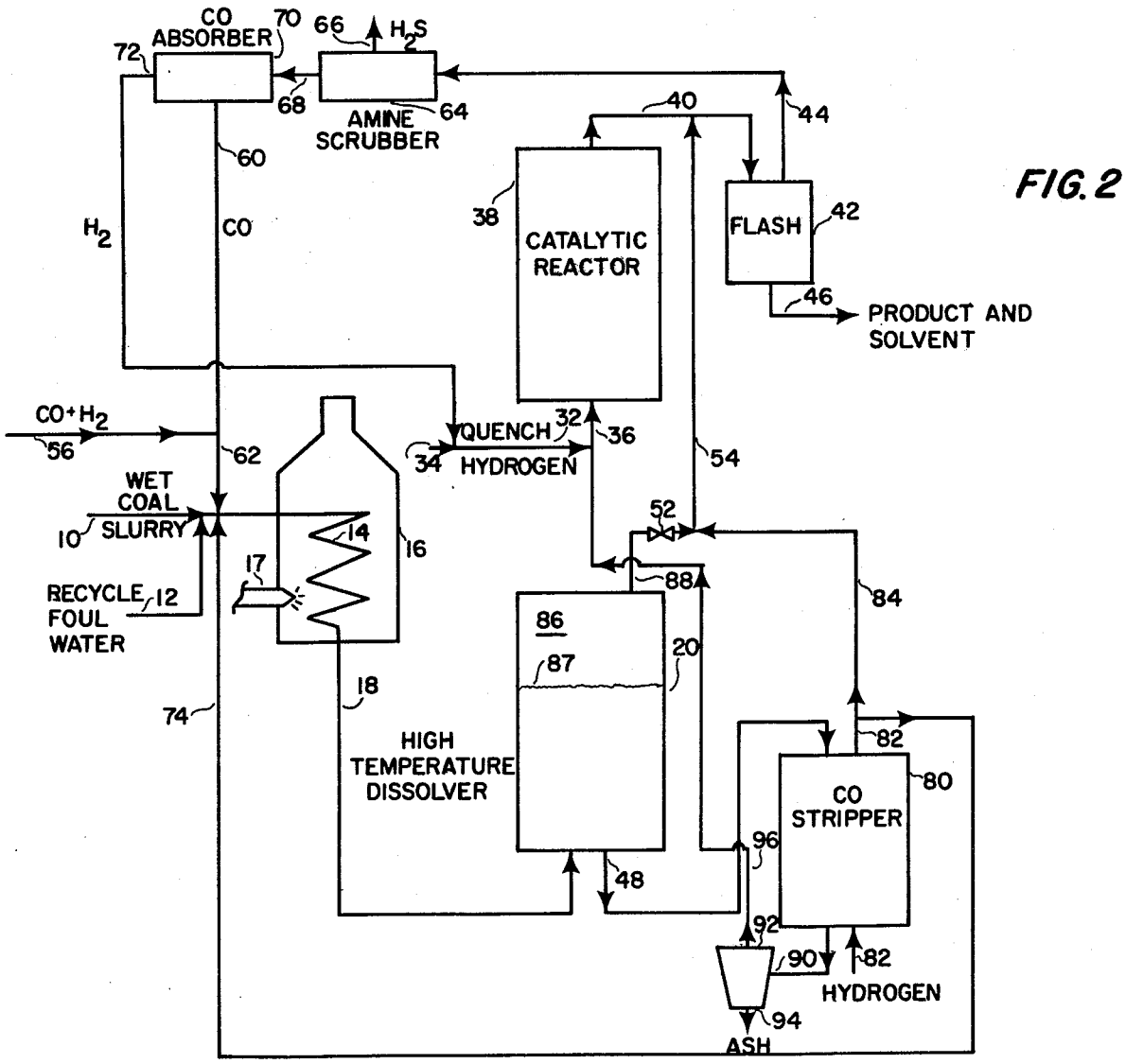

A process scheme of this invention is shown in FIG. 2. As shown in FIG. 2, a slurry of pulverized wet feed coal and recycle or make-up solvent in line 10 is mixed with mixtures of hydrogen and carbon monoxide entering through lines 62 and 74 and with unprocessed recycle foul water entering through line 12, all from a source in the process explained below. The stream then flows without backmixing through coil 14 in preheater furnace 16. Furnace 16 is heated by means of a flame from oil burner nozzle 17. The residence time in preheater 16 is between about 2 and 20 minutes and the temperature of the stream leaving preheater 16 through line 18 is between about 710° and 800° F. (377° and 427° C.). This stream flows into high severity dissolver zone 20. The temperature in dissolver 20 is between about 750° and 900° F. (399° and 482° C.) and the residence time in dissolver 20 is between about 5 and 60 minutes. Dissolver effluent containing dissolved carbon monoxide flows through line 48 to carbon monoxide stripper 80 wherein it flows downwardly in contact with upwardly flowing stripper hydrogen entering through line 82. A mixture of hydrogen and carbon monoxide is recovered from the stripper in line 82 from which it can be recycled to the preheater through line 74, if desired, or passed through line 84 to admix with the mixture of carbon monoxide, hydrogen and light hydrocarbons vented from the gaseous zone 86 above liquid level 87 of dissolver 20 through line 88 and valve 52. The streams in lines 84 and 88 are mixed in line 54. Stripper effluent liquid flows through line 90 to hydroclone 92 from which ash is removed through line 94 and low ash liquid is removed through line 96. The liquid can be quenched with hydrogen passing through line 32, if required, to a temperature between about 700° and 800° F. (371° and 427° C.) and passed into catalytic reactor 38. The quench hydrogen in line 32 includes recycle hydrogen from line 72 and make-up hydrogen from line 34.

Catalytic reactor 38 contains fixed beds of hydrogenation catalyst disposed in vertical columns enclosed by perforated compartments communicating with alternate vertical zones free of catalyst. The hydrogenation catalyst comprises Group VI and Group VIII metals on a non-cracking support. The liquid leaving reactor 38 in line 40 contains partially saturated aromatic molecules and is mixed with the stream in line 54 prior to passage to a flash chamber 42. Carbon monoxide and hydrogen-containing gases are removed from the flash chamber through line 44 for purification and recycle, while liquid removed through line 46 comprises both product for removal from the process and solvent for recycle to line 10.

Process gases vented from flash chamber 42 passing through line 44 enter an amine scrubber 64 in which hydrogen sulfide is separated and is discharged through line 66. The hydrogen sulfide-free gases leaving the amine scrubber through line 68 pass through a carbon monoxide absorber chamber 70. Carbon monoxide is removed from these gases in chamber 70 and passed to the preheater feed stream through lines 60 and 62. Make-up carbon monoxide and hydrogen enters line 62 through line 56. A hydrogen stream which is relatively free of hydrogen sulfide and carbon monoxide is recovered from chamber 70 through line 72 and passes to quench hydrogen line 32 for entry into the catalytic reactor 38.

In accordance with the process scheme of the drawing, a mixture of hydrogen and carbon monoxide is used in the preheater and dissolver zones only. The shift reaction not only produces in situ hydrogen for the preheater and dissolver zones but also concomitantly consumes some of the water present in the feed coal and recycled through line 12, thereby alleviating a foul water disposal problem. By venting the carbon monoxide-containing gases from the dissolver chamber through line 88, by scrubbing the dissolver effluent liquid in zone 80 and charging a purified hydrogen stream to the catalytic reactor, the catalytic reactor is protected from the poisoning effect which even small amounts of carbon monoxide are known to exert on hydrogenation catalysts.

The quantity of carbon monoxide charged through line 62 to the preheater and dissolver zones can be sufficiently great so that when it reacts with the water present in the preheater and dissolver zones an excess of hydrogen is produced beyond the hydrogen requirements of those zones. In this manner, carbon monoxide, which is prevented itself from reaching the catalyst zone, produces hydrogen in the initial process non-catalytic stages which is subsequently employed in a relatively carbon monoxide-free condition in the catalyst zone.

We claim:

1. A process for liquefying coal at a hydrogen pressure above 3,100 psi comprising passing a water-containing feed coal-solvent slurry and a gaseous stream containing carbon monoxide through a tubular preheater zone to increase the temperature of the slurry to a maximum temperature in the range from 710° to below 800° F. and to react carbon monoxide with water to produce hydrogen, passing an effluent stream from said preheater zone to a dissolver zone maintained at a temperature which is at least 10° F. higher than the maximum temperature in the preheater zone and which is between about 750° and 900° F., the residence time in the dissolver zone being longer than in the preheater zone, separating a dissolver zone effluent gaseous stream containing carbon oxides and hydrogen from a dissolver zone effluent liquid stream, fractionating said gaseous stream into a carbon monoxide-rich stream and a hydrogen-rich stream, recycling at least a portion of said carbon monoxide-rich stream to said preheater zone, and passing at least a portion of said hydrogen-rich stream and said dissolver zone effluent liquid stream to a catalytic hydrogenation zone maintained at a temperature in the range 700° to 825° F.

2. The process of claim 1 wherein the hydrogen pressure is above 3,500 psi.

3. The process of claim 1 wherein hydrogen produced in said preheater zone is consumed in said dissolver zone.

4. The process of claim 1 wherein sodium carbonate in aqueous solution is added to said preheater zone.

5. The process of claim 1 wherein said dissolver zone effluent gaseous stream is obtained by venting a gaseous stream containing carbon oxides and hydrogen from said dissolver zone.

6. The process of claim 1 wherein said dissolver zone effluent gaseous stream is obtained by passing dissolver zone effluent liquid to a stripping zone wherein carbon monoxide is stripped therefrom with hydrogen to obtain a gaseous stream comprising carbon oxides and hydrogen.

7. The process of claim 6 wherein an ash-containing slurry is separated from stripping zone effluent.

8. The process of claim 1 wherein at least 4,000 standard cubic feet of hydrogen per ton of feed coal are chemically consumed in said catalytic hydrogenation zone.

9. The process of claim 1 wherein at least 10,000 standard cubic feet of hydrogen per ton of feed coal are chemically consumed in said catalytic hydrogenation zone.

10. The process of claim 1 wherein foul water produced in said process is recycled to said process.

11. The process of claim 1 wherein the temperature in the dissolver zone is at least 50° F. higher than the temperature in the preheater zone.

12. The process of claim 1 wherein the temperature in the dissolver zone is at least 100° F. higher than the temperature in the preheater zone.

13. The process of claim 1 wherein the residence time in the preheater zone is 2 to 20 minutes.

14. The process of claim 1 wherein the residence time in the dissolver zone is 5 to 60 minutes.

15. The process of claim 1 wherein the temperature in the catalytic hydrogenation zone is lower than in the dissolver zone.

16. The process of claim 1 wherein the liquid residence time in the catalytic hydrogenation zone is lower than in the dissolver zone.

* * * * *